US009620317B1

(12) United States Patent
Hacker et al.

(10) Patent No.: US 9,620,317 B1
(45) Date of Patent: Apr. 11, 2017

(54) MAGNETICALLY-ACTUATED, HERMETICALLY-SEALED SWITCH DEVICE

(71) Applicant: A-T Controls, Inc., Cincinnati, OH (US)

(72) Inventors: Steven Hacker, Villa Hills, KY (US); Mark E Peters, Hamilton, OH (US)

(73) Assignee: A-T Controls, Inc., Cincinnati, OH (US)

( * ) Notice: Subject to any disclaimer, the term of this patent is extended or adjusted under 35 U.S.C. 154(b) by 0 days.

(21) Appl. No.: 15/000,210

(22) Filed: Jan. 19, 2016

(51) Int. Cl.
*H01H 9/04* (2006.01)
*H01H 36/00* (2006.01)

(52) U.S. Cl.
CPC ..... *H01H 36/00* (2013.01)

(58) Field of Classification Search
CPC ..... H01H 36/00; H01H 3/46; H01H 13/20; H01H 9/04
See application file for complete search history.

(56) References Cited

U.S. PATENT DOCUMENTS 8,294,541 B2 10/2012 Soldo
8,674,794 B1 * 3/2014 Oetjen ..... H01H 11/00 335/205
2001/0032841 A1 * 10/2001 Fukushima ..... H05B 6/6447 219/723

* cited by examiner

*Primary Examiner* — Bernard Rojas
(74) *Attorney, Agent, or Firm* — Theresa Camoriano; Duncan Galloway Egan Greenwald PLLC

(57) ABSTRACT

A switch having a spring-biased actuator button that moves in an axial direction is mounted in a hermetically sealed cavity defined in a one-piece housing, which also houses a tripping magnet and restricts the tripping magnet to linear movement along the axis of the actuator button.

11 Claims, 8 Drawing Sheets

MAGNETICALLY-ACTUATED, HERMETICALLY-SEALED SWITCH DEVICE

The present invention relates to a magnetically-actuated, hermetically sealed switch device.

Prior art switches, such as the switch device disclosed in U.S. Pat. No. 8,294,541 Soldo et al., dated Oct. 23, 2012, include a two-piece housing (See FIG. 1 of the Soldo patent) which is glued or welded together to make it hermetically sealed. The glued or welded joint is a potential problem area susceptible to failure, especially in high vibration environments.

The device in the '541 patent uses a target magnet outside the housing to move a tripping magnet inside the housing, which, in turn moves a transmission body, which, in turn moves a switch button to actuate the switch. Each of these components has its own inertia and friction, all of which have to be overcome in order to actuate the switch. In order to overcome this inertia and friction, the target magnet and the tripping magnet are large in order to have enough power to push the tripping magnet and other components so as to actuate the switch.

The more massive the magnets, the more susceptible they are to vibration from the equipment on which they are mounted. This vibration can lead to false actuation of the switch. Therefore, it is desirable to reduce the inertia and friction in the system in order to be able to reduce the mass of the magnets so as to avoid false actuation problems.

SUMMARY

An embodiment of the present invention provides a hermetically-sealed switch which addresses the shortcomings of the prior art switches discussed above. A potted, one-piece housing is used to eliminate potential problems of moisture intrusion due to failure of a joint in a two-piece housing. This also results in a switch suitable for installation in hazardous area locations (specifically suitable for installation in Class 1, Division II hazardous area classification locations).

In addition, the housing provides an extended bearing surface made from a low-friction, engineered polymer, which fully supports and guides the outer surface of the tripping magnet as the tripping magnet travels from its "at rest" position to its depressed, actuating position. This minimizes friction and prevents failure due to skewing and wedging of the tripping magnet in the housing.

Also, the transmission body found in the prior art switch has been eliminated, which eliminates the inertia and friction due to the transmission body and permits smaller magnets to be used, which reduces problems of false actuation described above.

The tripping and target magnets preferably are rare-earth magnets, which are able to provide stronger magnetic fields with smaller mass than prior art magnets.

In addition, a snap-action internal switch is provided to handle high-current switching applications and to eliminate the detrimental "teasing" effect of current arcing across the switch due to slow actuation of the switch.

DESCRIPTION

Figure 1:
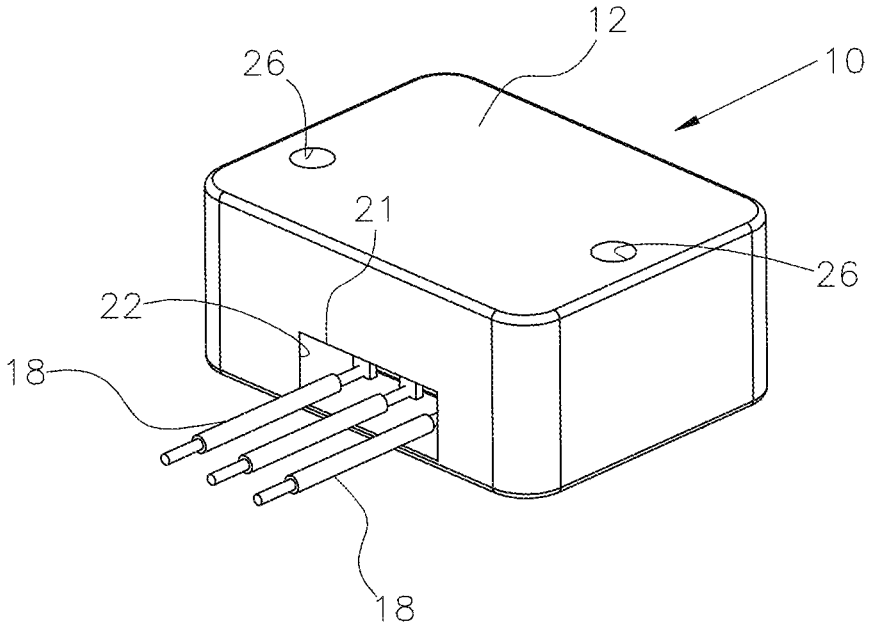
FIG. 1 is a perspective view of one embodiment of a switch device made in accordance with the present invention.
Figure 2:
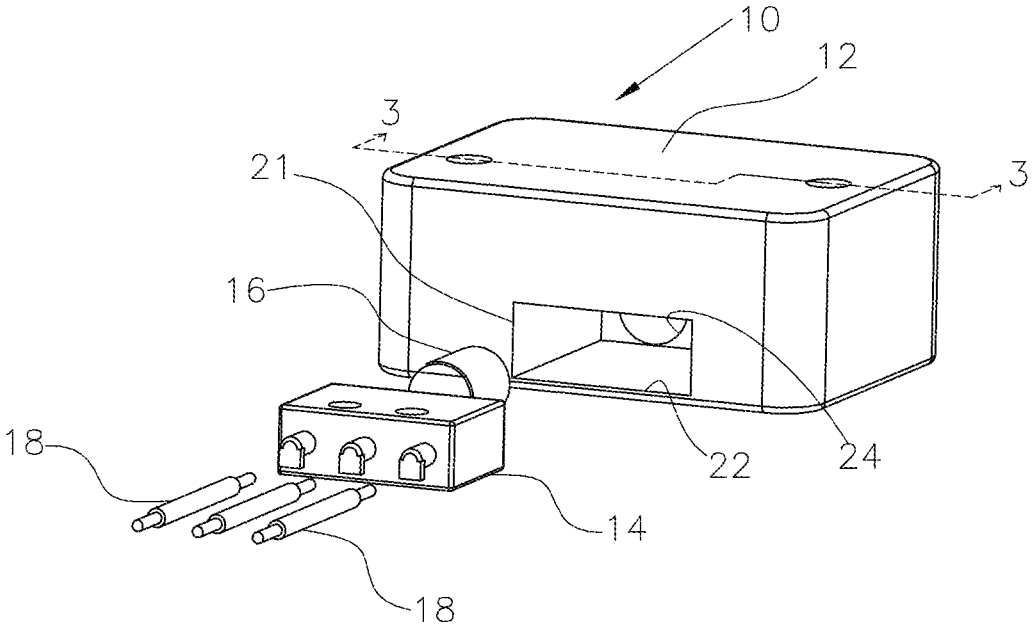
FIG. 2 is a partially-exploded perspective view of the switch device of FIG. 1.

FIGS. 1-8 show a switch device 10, made in accordance with the present invention. Referring to FIGS. 1 and 2, the switch device 10 includes a one-piece housing wall 12, defining an opening 21 into a first cavity portion 22, and a necked-down entrance 25 into a second cavity portion 24, which is farther away from the opening 21 than the first cavity portion 22. A tripping magnet 16 passes through the opening 21 into the first cavity portion 22 and then through the necked-down entrance 25 and is received in the second cavity portion 24. A switch 14 passes through the opening 21 and is received in the first cavity portion 22, abutting the necked-down entrance 25. A plurality of electrical terminals 18 project out of the switch 14 and out of the housing 12 through the opening 21. A spring-biased actuator button 28 projects from the switch 14, through the necked-down entrance 25, into the second cavity portion 24. Not explicitly depicted in FIGS. 1 and 2 is potting material 20 (See FIG. 5), which is poured into the opening 21 in the housing 12 once the other components are assembled in the housing 12 in order to fill the space between the switch 14 and the opening 21 to hermetically seal the switch 14 and tripping magnet 16, as discussed in more detail later.

Figure 3:
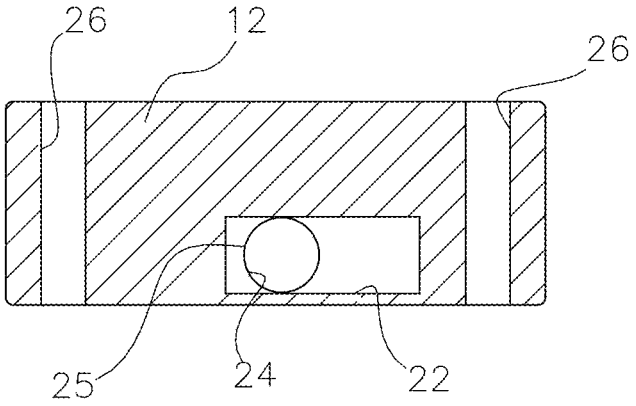
FIG. 3 is a section view along section 3-3 of FIG. 2.
Figure 4:
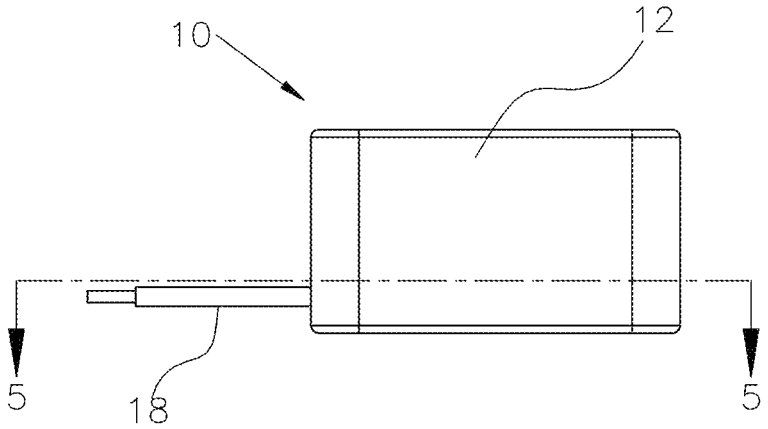
FIG. 4 is a side view of the switch of FIG. 1.
Figure 5:
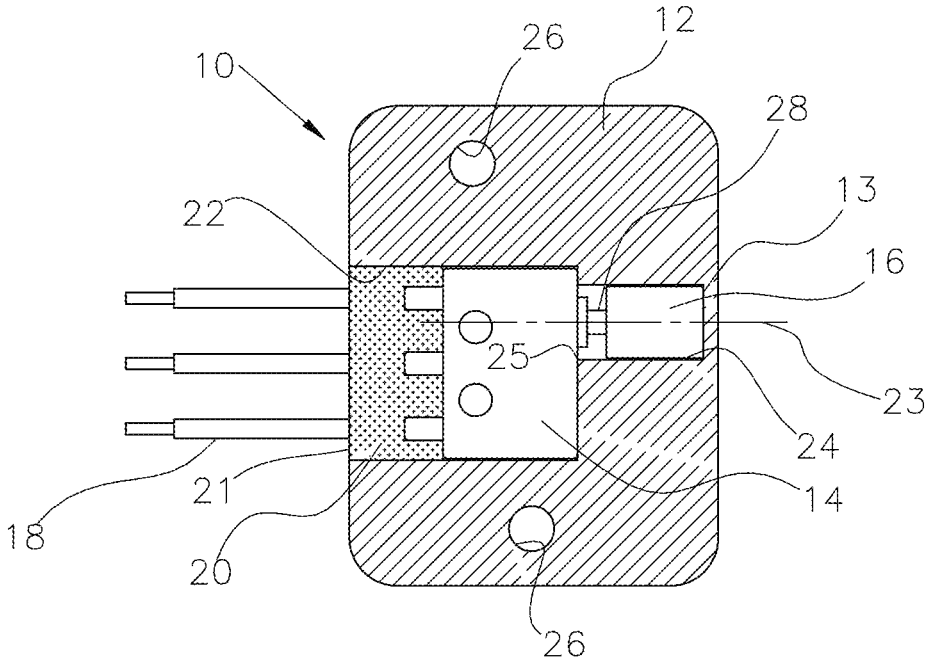
FIG. 5 is a section view along section 5-5 of FIG. 4 with the switch device in its "at rest", deactuated position.

As shown in FIGS. 2, 3, and 5, the housing 12 is a one-piece housing preferably manufactured in a 3-D printing process or machined from a single block of non-magnetic, engineered polymer material. Some examples of materials that might be used include Delrin® or Ultem®. Delrin® is a DuPont registered trademark product used in precision parts requiring high stiffness, low friction, and excellent dimensional stability. Ultem® is a Sabic registered trademark product which offers elevated thermal resistance, high strength and stiffness, and broad chemical resistance.

The housing wall 12 defines the first cavity portion 22, which, in this embodiment, is in the shape of a rectangular prism. This first cavity portion 22 preferably is sized to snugly receive the switch 14 and provides sufficient depth to allow for the proximal ends of the electrical terminals 18 to be connected to the switch 14 within the confines of the first cavity portion, as seen in FIG. 5.

Figure 6:
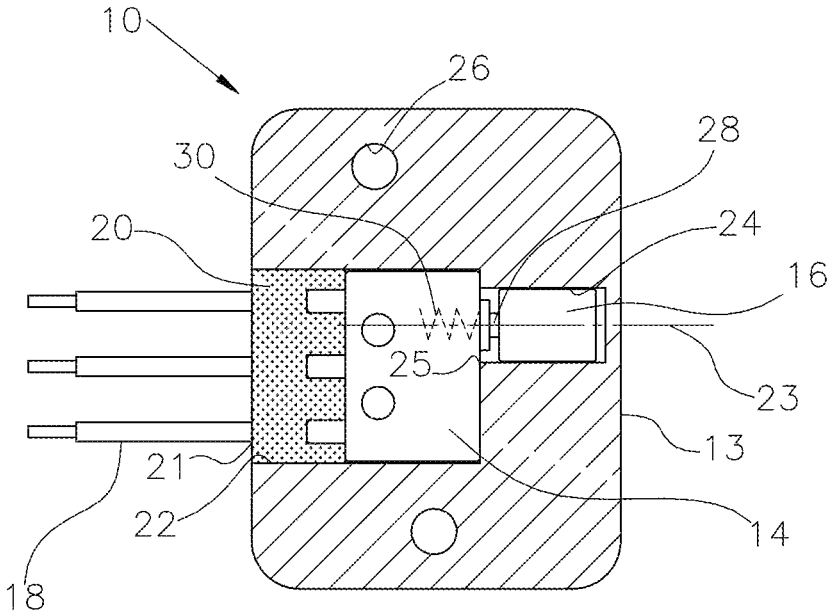
FIG. 6 is a view, similar to that of FIG. 5, but with the switch device in the depressed, actuated position.

The housing wall 12 also defines the necked-down, second cavity portion 24, which is cylindrical. This cylindrical cavity 24 is sized to snugly receive a cylindrical tripping magnet 16. The cylindrical cavity 24 is longer in the axial direction than the tripping magnet 16 in order to permit the tripping magnet 16 to move back and forth in the axial direction within the cylindrical cavity 24. Since the housing wall 12 preferably is manufactured from a low-friction engineered-polymer, it provides a low-friction bearing and guide surface for the tripping magnet 16. As shown in FIGS. 5 and 6, the axis 23 of the cylindrical cavity 24 is coaxial with the axis 23 of the tripping magnet 16 and with the axis 23 of the actuator button 28 of the switch 14, which restricts the tripping magnet 16 to linear movement along the switch axis 23. This low-friction guide surface allows ease of travel for the tripping magnet 16. Moreover, since the tripping magnet 16 is fully supported along its sides by the wall of the second cavity portion 24, there is no possibility for the tripping magnet 16 to become cocked or skewed as it travels along the longitudinal axis 23, resulting in a reliably and consistently smooth axial movement of the tripping magnet 16 within the second cavity portion 24.

Finally, the housing 12 defines two through openings 26 (See FIG. 3) for receiving screws or other fasteners (not shown) to mount the switch device 10 onto a support surface (not shown). These openings 26 are spaced away from the first and second cavity portions 22, 24 and thus do not interfere with the seal. It should also be noted that the second cavity portion 24 terminates very close to the end wall 13 of the housing 12 directly opposite the first opening 22 (See FIGS. 5 and 6). The tripping magnet 16 can then be repelled by the target magnet through this end wall 13 of the housing 12 (as explained in more detail later), so that the switch 14 can be actuated without compromising the hermetic integrity of the switch device 10.

In a preferred embodiment, the switch 14 is a single pole, double throw (SPDT) snap-action switch. It includes a spring-biased actuator button 28, which moves linearly, along an actuator button axis 23, from a depressed, actuated position to an extended, deactuated position. The switch 14 includes an internal biasing spring 30 (See FIG. 6) which urges the actuator button 28 and the tripping magnet 16 towards the deactuated position (towards the right as seen from the vantage point of FIGS. 5 and 6). As explained in more detail later, a target magnet 31 outside of the housing 12 (See FIGS. 7 and 8) may be moved to a location where it is directly opposite the tripping magnet 16. The target magnet 31 is a like-pole magnet, and it repels the tripping magnet 16 with sufficient force to overcome the biasing force of the spring 30 acting on the actuator button 28 in the switch 14 and to overcome any system friction forces and mass inertia forces inherent in the switch device 10 in order to depress the actuator button 28.

The tripping magnet 16 preferably is a Rare-earth magnet, either a neodymium magnet or a samarium-cobalt magnet, the strongest type of permanent magnets made, producing significantly stronger magnetic fields than other types of magnets. The tripping magnet 16 slides axially within the second cavity portion 24 from a rightmost, "at rest" position (as seen from the vantage point of FIG. 5), to a leftmost, depressed, actuated position (See FIG. 6). The first cavity portion 22 and the second cavity portion 24 are sized such that there is essentially no slack between the tripping magnet 16, the actuator button 28, and the internal switch 14 when the components are assembled inside the switch device 10.

Once the tripping magnet 16 and the switch 14 are assembled into the housing 12, and once the electrical terminals 18 are connected to the internal switch 14, a potting material 20 (See FIGS. 5 and 6) is poured through the first opening 21 to fill the space between the first opening 21 and the switch 14, to hermetically seal off the switch 14 and the tripping magnet 16 from the outside of the housing 12. It should be noted that the potting material 20 does not reach beyond the switch 14 into the second cavity portion 24, so the potting material 20 does not interfere with the axial movement of the tripping magnet 16 within the second cavity portion 24.

Figure 7:
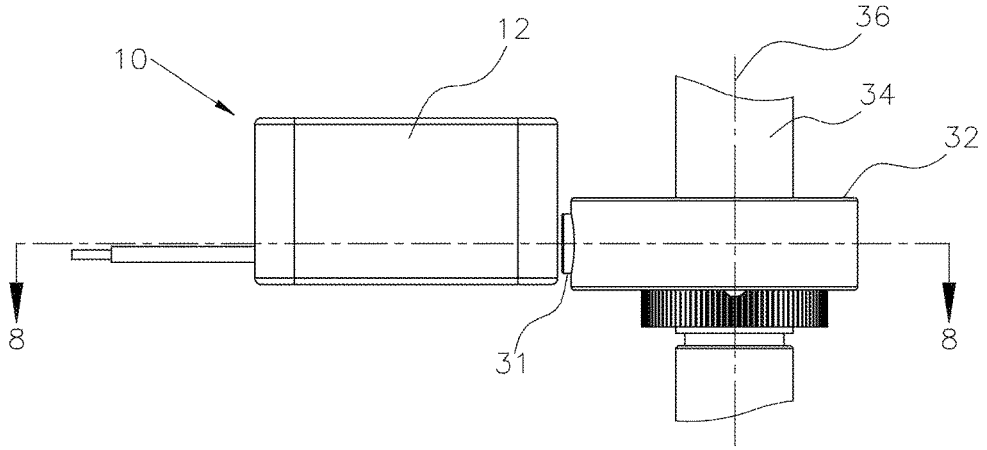
FIG. 7 is a broken-away view of the switch device of FIG. 4 but also showing an eccentrically-mounted target magnet mounted to a shaft.
Figure 8:
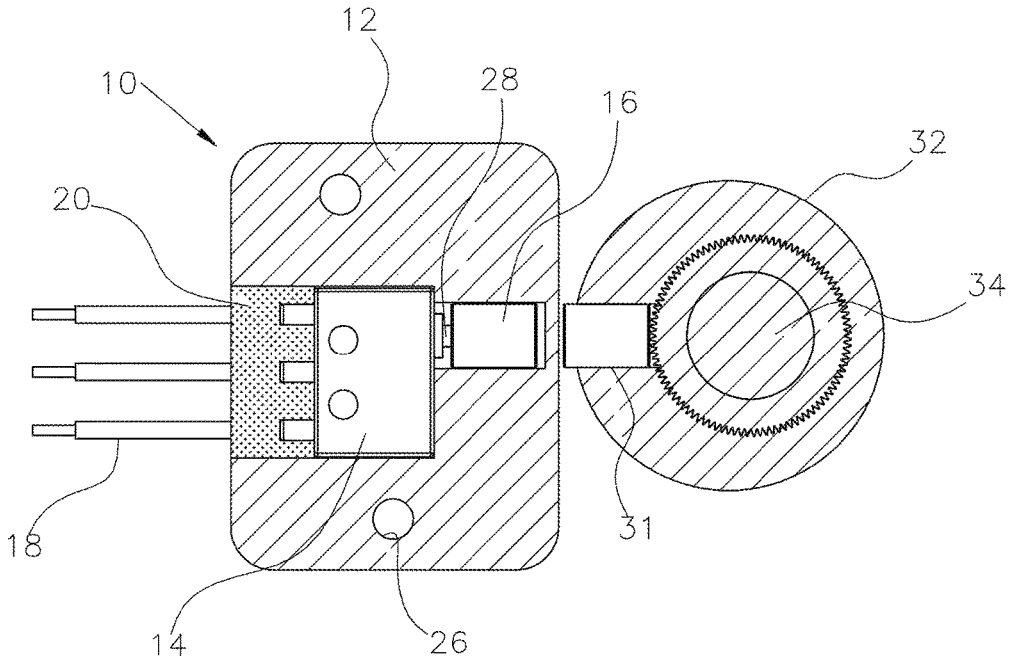
FIG. 8 is a section view along line 8-8 of FIG. 7.

Referring now to FIGS. 7 and 8, a target magnet 31 is mounted to an eccentric body 32 that is mounted for rotation on a shaft 34. The target magnet 31 extends only a short arcuate distance around the shaft 34, so that, as the shaft 34 rotates, the target magnet 31 lies directly opposite the tripping magnet 16 for only a short arcuate distance of travel of the shaft 34, and, when the target magnet 31 lies directly opposite the tripping magnet 16, the target magnet 31 provides a magnetic field that pushes the tripping magnet 16 away from the target magnet 31 to the depressed position, depressing the actuator button 28 against the biasing spring 30 to actuate the switch 14. When the target magnet 31 rotates away from the directly opposite position, the biasing spring 30 pushes the actuator button 28 back to the extended, de-actuated position and pushes the tripping magnet 16 to the "at rest" position.

It will be obvious to those skilled in the art that modifications may be made to the embodiment described above without departing from the scope of the present invention as claimed.

What is claimed is:

1. A switch device, comprising:

a one-piece housing wall defining a first opening into a first cavity portion, and defining a necked-down entrance from said first cavity portion to a second cavity portion, which is farther away from said first opening than said first cavity portion;

a tripping magnet sized to pass through said first opening and through said necked-down entrance, said tripping magnet being received in said second cavity portion;

a switch sized to pass through said first opening and to abut said necked-down entrance, said switch being received in said first cavity portion and being electrically connected to at least one connection terminal projecting out of said first cavity portion through said first opening; said switch including an actuator button biased by a biasing spring, said actuator button moving axially, along an actuator button axis, from a deactuated position to an actuated position;

wherein said second cavity portion is shaped to receive said tripping magnet with a close enough fit to serve as a guide track that restricts movement of said tripping magnet to linear movement along said actuator button axis, from an "at rest", deactuated position, to a depressed position in which the tripping magnet depresses the actuator button against the biasing spring to actuate the switch;

wherein there is a space between said first opening and said switch, and wherein a potting material fills said space to seal said switch and said tripping magnet inside said one-piece housing.

2. A switch device as recited in claim 1, wherein said tripping magnet has a cylindrically-shaped outer surface, and said guide track defines a cylindrically-shaped cavity which receives the cylindrically-shaped outer surface of said tripping magnet to provide a large bearing surface.

3. A switch device as recited in claim 2, and further comprising:

a shaft mounted external to said housing and rotatable about an axis of rotation that is perpendicular to said actuator button axis;

a target magnet mounted on said shaft for rotation with said shaft, said target magnet extending only a short arcuate distance around said shaft, so that, as the shaft rotates, the target magnet lies directly opposite the tripping magnet for only a short arcuate distance of travel of said shaft, and, when the target magnet lies directly opposite the tripping magnet, the target magnet provides a magnetic field that pushes the tripping magnet away from the target magnet, from the "at rest" position to the depressed position, and, when the target magnet rotates away from the directly opposite position, said biasing spring pushes the actuator button to the de-actuated position and pushes the tripping magnet to the "at rest" position.

4. A switch device as recited in claim 3, wherein said target magnet is mounted on an eccentric body that is mounted on said shaft.

5. A switch device as recited in claim 4, wherein the tripping magnet directly contacts the actuator button to move the actuator button to the actuated position.

6. A switch device as recited in claim 1, wherein said tripping magnet is a Rare-earth magnet selected from the group consisting of neodymium and samarium-cobalt magnets.

7. A switch device as recited in claim 1, wherein said switch is a snap-action electrical switch.

8. A switch device as recited in claim 1, wherein said housing wall is made from a non-magnetic, low friction, polymer material selected from the group consisting of Delrin® and Ultem®.

9. A switch device as recited in claim 2, wherein said switch is a snap-action electrical switch, said housing is made from a non-magnetic, low friction, polymer material selected from the group consisting of Delrin® and Ultem®, and said tripping magnet is a Rare-earth magnet selected from the group consisting of neodymium and samarium-cobalt magnets.

10. A switch device as recited in claim 9, and further comprising:

a shaft mounted external to said housing and rotatable about an axis of rotation that is perpendicular to said actuator button axis;

a target magnet mounted on said shaft for rotation with said shaft, said target magnet extending only a short arcuate distance around said shaft, so that, as the shaft rotates, the target magnet lies directly opposite the tripping magnet for only a short arcuate distance of travel of said shaft, and, when the target magnet lies directly opposite the tripping magnet, the target magnet provides a magnetic field that pushes the tripping magnet away from the target magnet, from the "at rest" position to the depressed position, and, when the target magnet rotates away from the directly opposite position, said biasing spring pushes the actuator button to the de-actuated position and pushes the tripping magnet to the "at rest" position.

11. A switch device as recited in claim 10, wherein said target magnet is mounted on an eccentric body that is mounted on said shaft.

* * * * *